US011342681B2

(12) United States Patent
Kocakarin et al.

(10) Patent No.: US 11,342,681 B2
(45) Date of Patent: May 24, 2022

(54) SECONDARY REFLECTOR WITH FREQUENCY SELECTIVE SURFACE

(71) Applicant: Profen Iletisim Teknolojileri Ve Hizmetleri Sanayi Ticaret Anonim Sirketi, Istanbul (TR)

(72) Inventors: Isa Kocakarin, Istanbul (TR); Seymur Shukurov, Istanbul (TR)

( * ) Notice: Subject to any disclaimer, the term of this patent is extended or adjusted under 35 U.S.C. 154(b) by 0 days.

(21) Appl. No.: 17/043,909

(22) PCT Filed: Nov. 5, 2019

(86) PCT No.: PCT/TR2019/050923
§ 371 (c)(1),
(2) Date: Sep. 30, 2020

(87) PCT Pub. No.: WO2020/122837
PCT Pub. Date: Jun. 18, 2020

(65) Prior Publication Data

US 2021/0021049 A1 Jan. 21, 2021

(30) Foreign Application Priority Data

Dec. 14, 2018 (TR) ..... 2018/19490

(51) Int. Cl.
*H01Q 15/00* (2006.01)
*H01Q 19/19* (2006.01)

(52) U.S. Cl.
CPC ..... *H01Q 15/0013* (2013.01); *H01Q 19/19* (2013.01)

(58) Field of Classification Search
CPC .. H01Q 15/0013; H01Q 15/006; H01Q 19/19; H01Q 5/45
See application file for complete search history.

(56) References Cited

U.S. PATENT DOCUMENTS 4,017,865 A 4/1977 Woodward
RE34,410 E * 10/1993 Rosen ..... H01Q 5/45 343/756

(Continued)

FOREIGN PATENT DOCUMENTS

EP 1496570 A1 1/2005
TR 2011/10652 10/2011

OTHER PUBLICATIONS

International Search Report for corresponding PCT/TR2019/050923, dated May 29, 2020.

(Continued)

*Primary Examiner* — Awat M Salih
(74) *Attorney, Agent, or Firm* — Egbert, McDaniel & Swartz, PLLC

(57) ABSTRACT

A secondary reflector is provided which has structural strength based on the hexagonal design and which show frequency selective features and low insertion loss. The antenna system includes a main reflector at which an incoming RF signal from a signal source reaches, a secondary reflector at which the incoming RF signal reaches by being reflected from the main reflector, a second antenna feed to which a transmitted RF signal through the secondary reflector is directed and a first antenna feed to which a reflected RF signal from the secondary reflector is directed. The surface of the secondary reflector has a dielectric support layer with hexagonal holes and a frequency selective surface located on the support layer and having circular rings.

2 Claims, 4 Drawing Sheets

(56) References Cited

U.S. PATENT DOCUMENTS

| | | | | |
|---|---|---|---|---|
| 5,373,302 | A | 12/1994 | Wu | |
| 5,471,224 | A | 11/1995 | Barkeshli | |
| 2003/0234745 | A1* | 12/2003 | Choung | H01Q 19/195<br>343/781 P |
| 2014/0225796 | A1* | 8/2014 | Chen | H01Q 19/132<br>343/781 CA |
| 2015/0236416 | A1* | 8/2015 | Fonseca | H01Q 5/30<br>343/837 |
| 2019/0051990 | A1* | 2/2019 | Luo | H01Q 19/191 |

OTHER PUBLICATIONS

Written Opinion of the International Searching Authority for corresponding PCT/TR2019/050923, dated May 29, 2020.

* cited by examiner

SECONDARY REFLECTOR WITH FREQUENCY SELECTIVE SURFACE

TECHNICAL FIELD

The invention relates to a secondary reflector with a frequency-selective surface to be used in antenna systems in general.

The invention specifically relates to an antenna system that comprises a secondary reflector with circular reflector elements and a support-layer with hexagonal holes.

STATE OF THE ART

Generally, the secondary reflector structures consist of metal reflective units located on a Kevlar support-layer. The Kevlar layer is a lightweight, carbon-based, solid fiber layer that has a high production cost and is difficult to manufacture. Transition losses are high in the secondary reflectors with Kevlar as a support layer since the entire surface consists of dielectric material.

Patent application no. TR201110652, which is encountered during technical research, a frequency selective surface integrated into the conductive coating related to a radome and a method to obtain this radome. This document mentions obtaining dome shaped radomes which are open to one or more forms of radiation. However, this document does not mention the structure of the frequency selective surface.

The patent application document no. U.S. Pat. No. 5,471,224A, which refers to the frequency selective surface in the state of the art, mentions a frequency selective surface using a dielectric layer with rings with hexagonal form. In this system, however, there is no mention of the existence of a frequency selective surface positioned above the dielectric layer and having a hexagonal hole structure.

As a result, improvements are being made in secondary reflectors with frequency selective surfaces, so new structures are needed that will eliminate the disadvantages mentioned above and provide solutions for existing systems.

PURPOSE OF INVENTION

The present invention relates to an antenna having a secondary reflector with a frequency selective surface that meets the requirements mentioned above while eliminating all disadvantages and providing some additional advantages.

The main purpose of the invention is to minimize the performance losses caused by dielectrics by using a minimum level of dielectric in the secondary reflector.

One purpose of the invention is to maintain the structural stability of the secondary reflector by using a dielectric support structure with closely placed hexagonal holes.

Another purpose of the invention is to reduce the production time and provide ease of manufacturing with 3D printing method.

Another purpose of the invention is to reduce the weight of the antenna with the dielectric support structure in the hexagonal hole structure located on the dielectric layer produced by a 3D printing method.

To achieve all of the aforementioned advantages and the ones that can be inferred from the detailed description given below, the invention comprises; a main reflector (3) at which an incoming RF signal (A) from a signal source reaches, a secondary reflector (4) by being reflected from the main reflector (3), a second antenna feed (6) to which a transmitted RF signal (C) through the secondary reflector (4) is directed and a first antenna feed (5) to which a reflected RF signal (B) from the secondary reflector (4) is directed. The surface of the secondary reflector (4) comprises a dielectric support layer (1) comprising hexagonal holes and a frequency selective surface (2) located on the support layer (1) which comprises circular rings.

The structural characteristics and all advantages of the invention will be understood more clearly through the following figures and the detailed explanation written regarding these figures. Therefore, the evaluation should be based on these figures and the detailed description.

BRIEF DESCRIPTION OF DRAWINGS

The configuration of the present invention and its advantages with further elements will become clear based on the drawings described below.

REFERENCE NUMBERS

Figure 1:
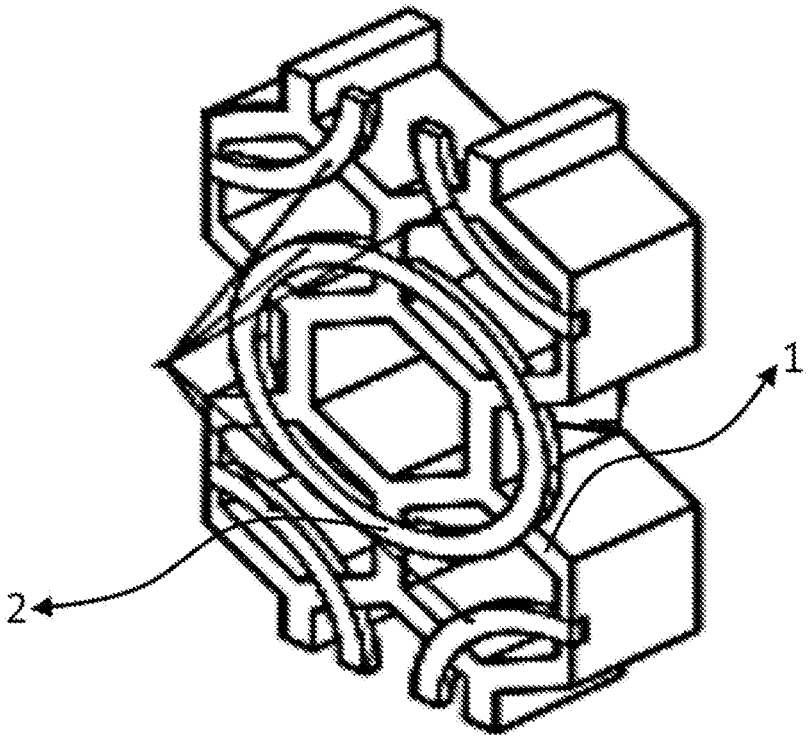
FIG. 1 is a cell view containing the ring structures used in the two-layer structure of the frequency selective surface used in the antenna system.

1. Dielectric support layer
2. Frequency selective surface
3. Main reflector
4. Secondary reflector
5. First antenna feed
6. Second antenna feed
A. Incoming RF signal
B. Reflected RF signal
C. Transmitted RF signal

DETAILED DESCRIPTION OF THE INVENTION

In the herein detailed description, the preferred embodiments of the secondary reflector with frequency selective surface of the invention are described only for a better understanding of the subject matter, without posing any limitations.

Figure 4:
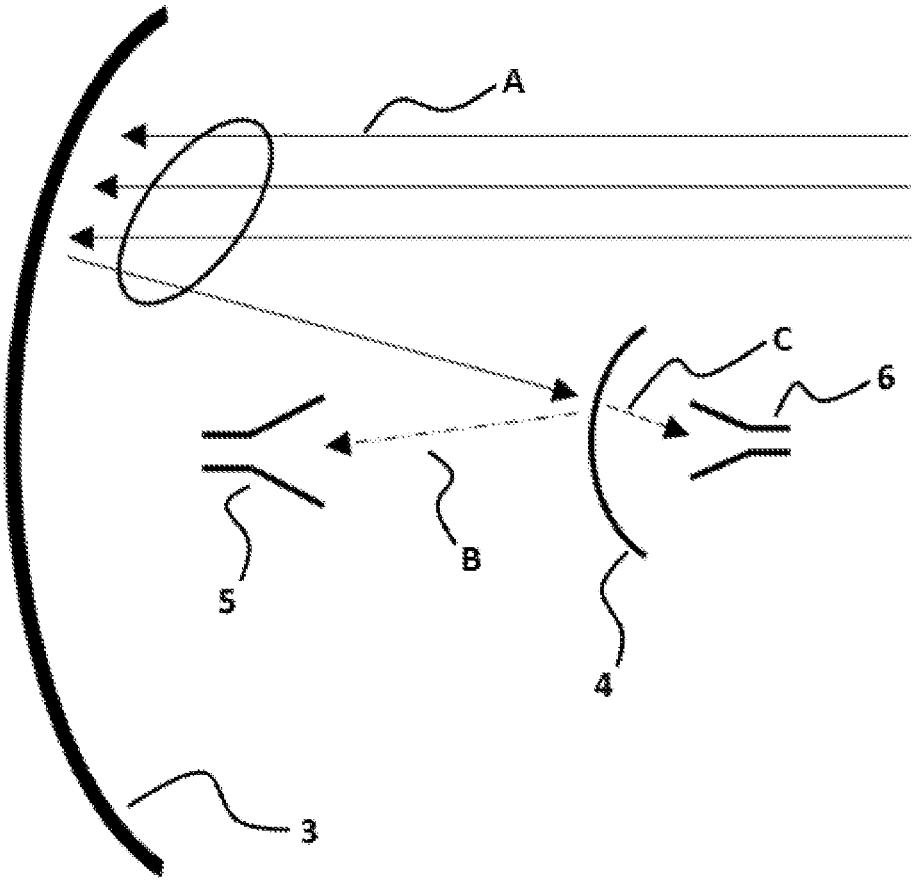
FIG. 4 is the overview of the antenna system of the invention.

FIG. 4 is an overview of the antenna system of the invention. The invention basically comprises; a main reflector (3) at which an incoming RF signal (A) from a signal source reaches, a secondary reflector (4) at which the incoming RF signal (A) reaches by being reflected from the main reflector (3), a second antenna feed (6) to which a transmitted RF signal (C) through the secondary reflector (4) is directed and a first antenna feed (5) to which a reflected RF signal (B) from the secondary reflector (4) is directed. The surface of the secondary reflector (4) comprises

- a dielectric support layer (1) comprising hexagonal holes and
- a frequency selective surface (2) located on the support layer (1) and comprising circular rings.

Figure 2:
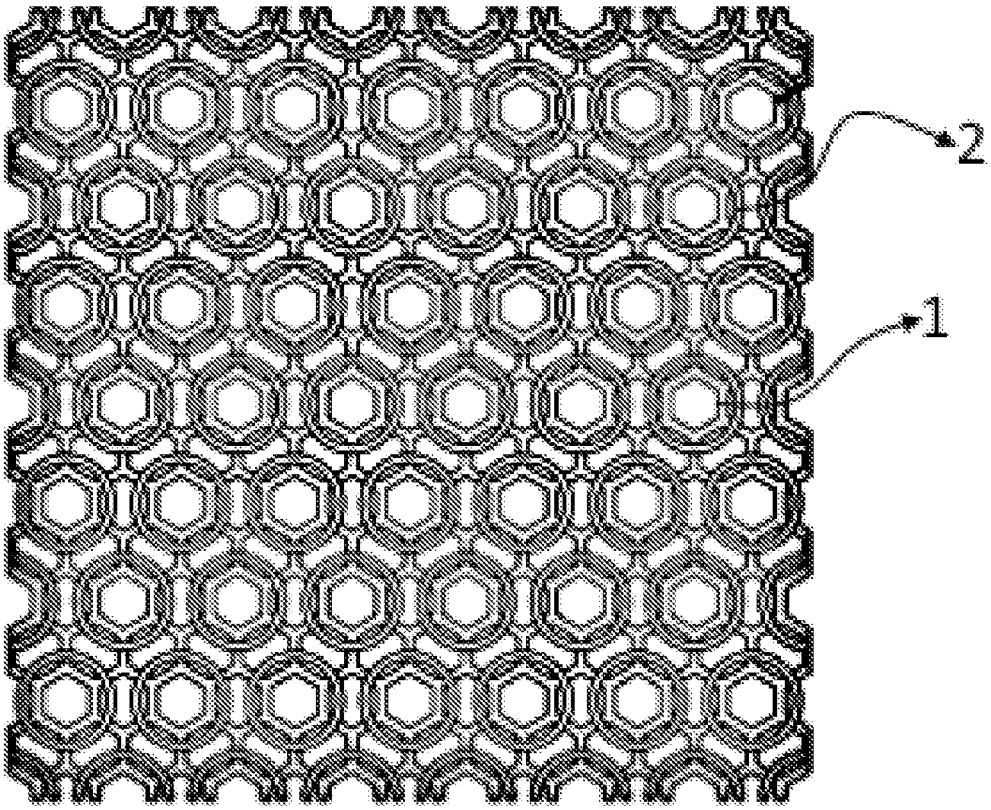
FIG. 2 is an overview of the two-layer structure of the frequency selective surface used in the antenna system of invention.
Figure 3:
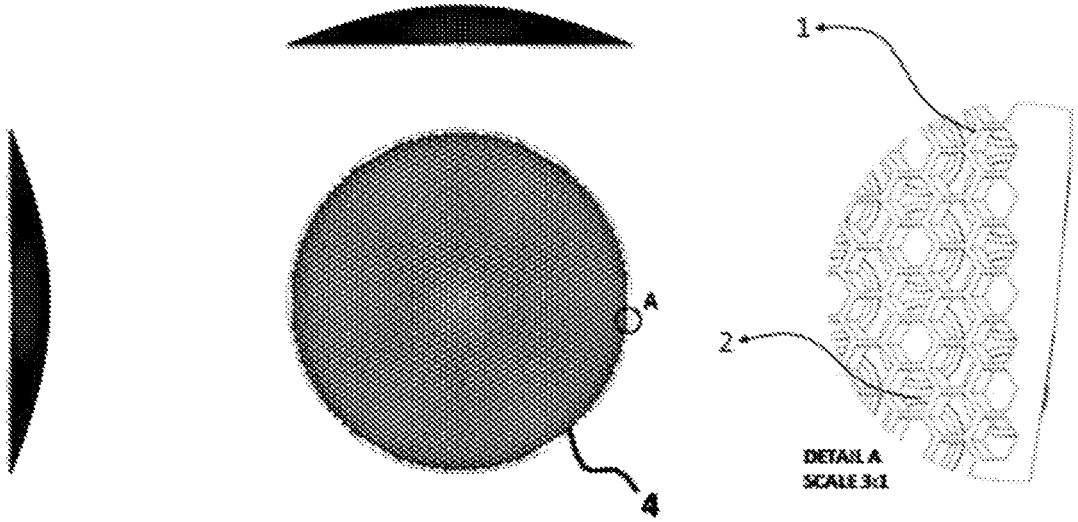
FIG. 3 is a detailed view of the frequency selective surface used in the antenna system of the invention.

The Operating Principle of the System is as Follows:

After the incoming RF signal (A) from the signal source is reflected from the main reflector (3), it is split into two parts as the transmitted RF signal (C) and the reflected RF signal (B) by the frequency selective surface (2) located on the support layer (1) located on this reflector (4). In order to minimize the losses due to the mentioned splitting process, the support layer (1) is in the form of a mesh consisting of hexagonal holes (FIGS. 1, 2 and 3). The frequency selective surface (2) positioned on the mentioned support layer (1) is in the form of a mesh consisting of circular rings placed in hexagonal pattern. Due to the hexagonal hole structure of the said frequency selective surface (2), the loss encountered during the splitting into two parts is at an ignorable level.

In the secondary reflector (4), metal units are positioned by means of dielectric material. The use of dielectric materials increases insertion loss on the frequency selective surface and decreases the reflection values. Due to being formed of hexagonal holes, performance losses from dielectrics are minimized by using a minimum level of material in the dielectric support layer (1).

FIGS. 1, 2 and 3 show the dielectric support layer of the secondary reflector antenna system consisting of hexagonal holes. There are circles around the hexagonal holes. There is no connection between circles and hexagons. In a preferred embodiment of the invention, hexagonal holes and circular rings are concentric in order to ensure mechanical stability.

The invention claimed is:

1. An antenna system comprising:

a main reflector adapted to receive an incoming RF signal from a signal source;

a secondary reflector adapted to receive the incoming RF signal reflected from said main reflector;

a first antenna feed to which a reflected RF signal from said secondary reflector is directed; and a second antenna feed to which a transmitted RF signal through said secondary reflector is directed, wherein a surface of said secondary reflector comprises:

a dielectric support layer having hexagonal holes; and a frequency selective surface located on said dielectric support, said frequency selective surface comprising circular rings.

2. The antenna system of claim 1, wherein the circular rings of said frequency selective surface are concentric with the hexagonal holes in said dielectric layer.

* * * * *